US011725837B2

(12) United States Patent
Brahme et al.

(10) Patent No.: US 11,725,837 B2
(45) **Date of Patent: *Aug. 15, 2023**

(54) DETECTION OF A REVERSING VALVE FAULT

(71) Applicant: Lennox Industries Inc., Richardson, TX (US)

(72) Inventors: Amita Brahme, Dallas, TX (US); Umesh Gokhale, Irving, TX (US)

(73) Assignee: Lennox Industries Inc., Richardson, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/651,924

(22) Filed: Feb. 22, 2022

(65) Prior Publication Data

US 2022/0178567 A1 Jun. 9, 2022

Related U.S. Application Data

(63) Continuation of application No. 16/832,255, filed on Mar. 27, 2020, now Pat. No. 11,293,659.

(51) Int. Cl.

| | |
|---|---|
| ***F24F 11/38*** | (2018.01) |
| ***F24F 11/86*** | (2018.01) |
| *F24F 110/12* | (2018.01) |
| *F24F 140/20* | (2018.01) |

(52) U.S. Cl.

CPC ..... *F24F 11/38* (2018.01); *F24F 11/86* (2018.01); *F24F 2110/12* (2018.01); *F24F 2140/20* (2018.01)

(58) Field of Classification Search

CPC .. F24F 11/38; F24F 11/67; F24F 11/86; F24F 2110/12; F24F 2140/40; F25B 2313/027; F25B 2313/02741; F25B 2313/0292

See application file for complete search history.

(56) References Cited

U.S. PATENT DOCUMENTS

| | | | | |
|---|---|---|---|---|
| 4,211,089 | A | 7/1980 | Mueller et al. | |
| 5,042,264 | A | 8/1991 | Dudley | |
| 9,638,436 | B2 | 5/2017 | Arensmeier et al. | |
| 11,193,686 | B2 | 12/2021 | Brahme et al. | |
| 11,293,659 | B2 * | 4/2022 | Brahme | F24F 11/67 |
| 2005/0262857 | A1 | 12/2005 | Hrejsa et al. | |
| 2017/0021700 | A1 | 1/2017 | Smith et al. | |
| 2021/0302040 | A1 | 9/2021 | Brahme et al. | |

* cited by examiner

*Primary Examiner* — Marc E Norman
(74) *Attorney, Agent, or Firm* — Baker Botts L.L.P.

(57) ABSTRACT

An HVAC system includes a reversing valve configured to receive refrigerant and direct the received refrigerant based on an operating mode of the HVAC system. A sensor measures a heat-exchanger temperature associated with an outdoor heat exchanger. A controller monitors an outdoor temperature and the heat-exchanger temperature and compares these temperatures. The controller determines whether the HVAC system is intended to operate in a cooling or heating mode. If the heat-exchanger temperature is less than the outdoor temperature and the HVAC system is intended to operate in the cooling mode, the controller determines that a first reversing-valve fault is detected. The first reversing-valve fault is associated with the reversing valve being in the heating configuration when the HVAC system is intended to operate in the cooling mode.

17 Claims, 6 Drawing Sheets

DETECTION OF A REVERSING VALVE FAULT

CROSS-REFERENCE TO RELATED APPLICATIONS

This application is a continuation of U.S. patent application Ser. No. 16/832,255 filed Mar. 27, 2020, by Amita Brahme et al., and entitled "DETECTION OF A REVERSING VALVE FAULT," which is incorporated herein by reference.

TECHNICAL FIELD

The present disclosure relates generally to heating, ventilation, and air conditioning (HVAC) systems and methods of their use. In certain embodiments, the present disclosure relates to detection of a reversing valve fault.

BACKGROUND

Heating, ventilation, and air conditioning (HVAC) systems are used to regulate environmental conditions within an enclosed space. Air is cooled or heated via heat transfer with refrigerant flowing through the system and returned to the enclosed space as conditioned air. In some cases, an HVAC system may be configured to operate as a heat pump. Such an HVAC system may include a reversing valve. The position of the reversing valve may be adjusted to reverse the flow of refrigerant through the HVAC system to operate according to a heating mode or a cooling mode.

SUMMARY OF THE DISCLOSURE

In an embodiment, an HVAC system includes a reversing valve configured to receive refrigerant and direct the received refrigerant based on an operating mode of the HVAC system. When the HVAC system is intended to operate in a cooling mode, the reversing valve is configured to direct the received refrigerant to an outdoor heat exchanger. When the HVAC system is intended to operate in a heating mode, the reversing valve is configured to direct the received refrigerant to an indoor heat exchanger. The HVAC system includes a sensor which measures a heat-exchanger temperature associated with the outdoor heat exchanger. A controller monitors an outdoor temperature and the heat-exchanger temperature. The controller compares the monitored outdoor temperature to the monitored heat-exchanger temperature. The controller determines whether the HVAC system is intended to operate in a cooling mode or heating mode. In response to determining that the heat-exchanger temperature is less than the outdoor temperature and that the HVAC system is intended to operate in the cooling mode, the controller determines that a first reversing-valve fault is detected, wherein the first reversing-valve fault is associated with the reversing valve being in the heating configuration when the HVAC system is intended to operate in the cooling mode.

In another embodiments, An HVAC system includes a reversing valve configured to receive compressed refrigerant and direct the refrigerant based on an operating mode of the HVAC system. When the HVAC system is intended to operate in a cooling mode, the reversing valve is configured to direct the received refrigerant to an outdoor heat exchanger. When the HVAC system is intended to operate in a heating mode, the reversing valve is configured to direct the received refrigerant to an indoor heat exchanger. One or more suction-side sensors measure suction-side properties associated with refrigerant provided to an inlet of the compressor. The suction-side properties comprise a suction-side temperature. One or more liquid-side sensors measure liquid-side properties associated with the refrigerant provided from an outlet of the compressor. The liquid-side properties comprise a liquid-side temperature. A controller monitors the suction-side temperature and liquid-side temperature. The controller determines whether the suction-side temperature is greater than the liquid-side temperature. If the suction-side temperature is greater than the liquid-side temperature, the reversing valve is determined to be in an equalizing configuration. The equalizing configuration corresponds to a configuration in which the refrigerant provided from the outlet of the compressor is directed to the inlet of the compressor without first being directed to other components of the HVAC system.

In some cases, an HVAC system may experience a fault (e.g., a malfunction of one or more components of the HVAC system, a loss of charge, or like). Conventional approaches to detecting an HVAC system fault generally rely on an individual recognizing a loss of system performance. For example, an occupant of an enclosed space being conditioned by an HVAC system may recognize that the space is not comfortable or is not reaching a desired temperature setpoint. Such approaches result in delayed detection of system faults, such that it may be too late to take efficient and effective corrective action once a fault is identified. For instance, by the time a fault is detected using conventional approaches, damage may have occurred to system components, resulting in a need for repairs which may be costly, complex, or even impossible. Furthermore, previous technology is generally not capable of determining that an HVAC system fault (e.g., associated with a loss of system performance) is caused by a malfunction of a reversing valve. Previous technology also fails to distinguish between different types of reversing valve malfunctions.

This disclosure provides technical solutions to problems of previous technology, including those described above, by facilitating the detection of an HVAC fault caused by a malfunctioning reversing valve and/or determining a type of reversing valve malfunction (e.g., whether caused by the valve being in the wrong position for heating or cooling, or caused by the valve being stuck in an equalizing configuration, as described in greater detail below). This disclosure encompasses the recognition that certain measurable properties associated with the HVAC system and/or the surrounding environment can be monitored to both detect a reversing valve malfunction and distinguish between different types of such malfunctions. For example, an outdoor temperature and a temperature associated with an outdoor heat exchanger can be monitored and used to detect a faulty reversing valve which is in the wrong position for providing the cooling or heating associated with the operating mode of the HVAC system, as described in greater detail below with respect to FIGS. 1A-B and FIG. 2. As another example, suction-side properties (e.g., temperature and/or pressure measurements) and liquid-side properties (e.g., temperature and/or pressure measurements) can be monitored and used to detect a faulty reversing valve which is stuck in an equalizing configuration, as described in greater detail below with respect to FIGS. 1C and FIG. 3. As such, this disclosure may be integrated into a practical application by providing an improved controller of an HVAC system, which more effectively detects reversing valve faults and provides information regarding the type of fault, such that appropriate corrective actions may be taken before the HVAC system is damaged. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Embodiments of the present disclosure and its advantages are best understood by referring to FIGS. 1A through 4 of the drawings, like numerals being used for like and corresponding parts of the various drawings.

As described above, prior to this disclosure, there was a lack of tools for effectively detecting reversing valve-related faults of an HVAC system. The systems and methods described in this disclosure provide solutions to these problems by facilitating the detection of reversing valve-related faults based on comparisons of particular combinations of measured properties. For example, an outdoor temperature and a temperature associated with an outdoor heat exchanger can be monitored and used to detect that a reversing valve is in the wrong position for the operating mode of the HVAC system, as described in greater detail below with respect to FIGS. 1A-B and FIG. 2. As another example, suction-side properties (e.g., temperatures and/or pressures) and liquid-side properties (e.g., temperatures and/or pressures) can be monitored and used to detect that a valve is stuck in an equalizing configuration, as described in greater detail below with respect to FIGS. 1C and FIG. 3.

As used in this disclosure a "suction-side property" refers to a property (e.g., a temperature or pressure) associated with refrigerant provided to an inlet of the compressor. For example, a suction-side property may be a temperature or pressure of refrigerant provided to a compressor of an HVAC system (e.g., refrigerant flowing into the inlet of the compressor or refrigerant flowing in conduit leading to the inlet of the compressor. As used in this disclosure, a "liquid-side property" refers to a property (e.g., a temperature or pressure) associated with refrigerant provided from an outlet of the compressor. For example, a liquid-side property may be a temperature or pressure of refrigerant provided from a compressor of an HVAC system (e.g., refrigerant flowing out of the outlet of the compressor or refrigerant flowing in conduit leading from the outlet of the compressor.

HVAC System

Figure 1A:
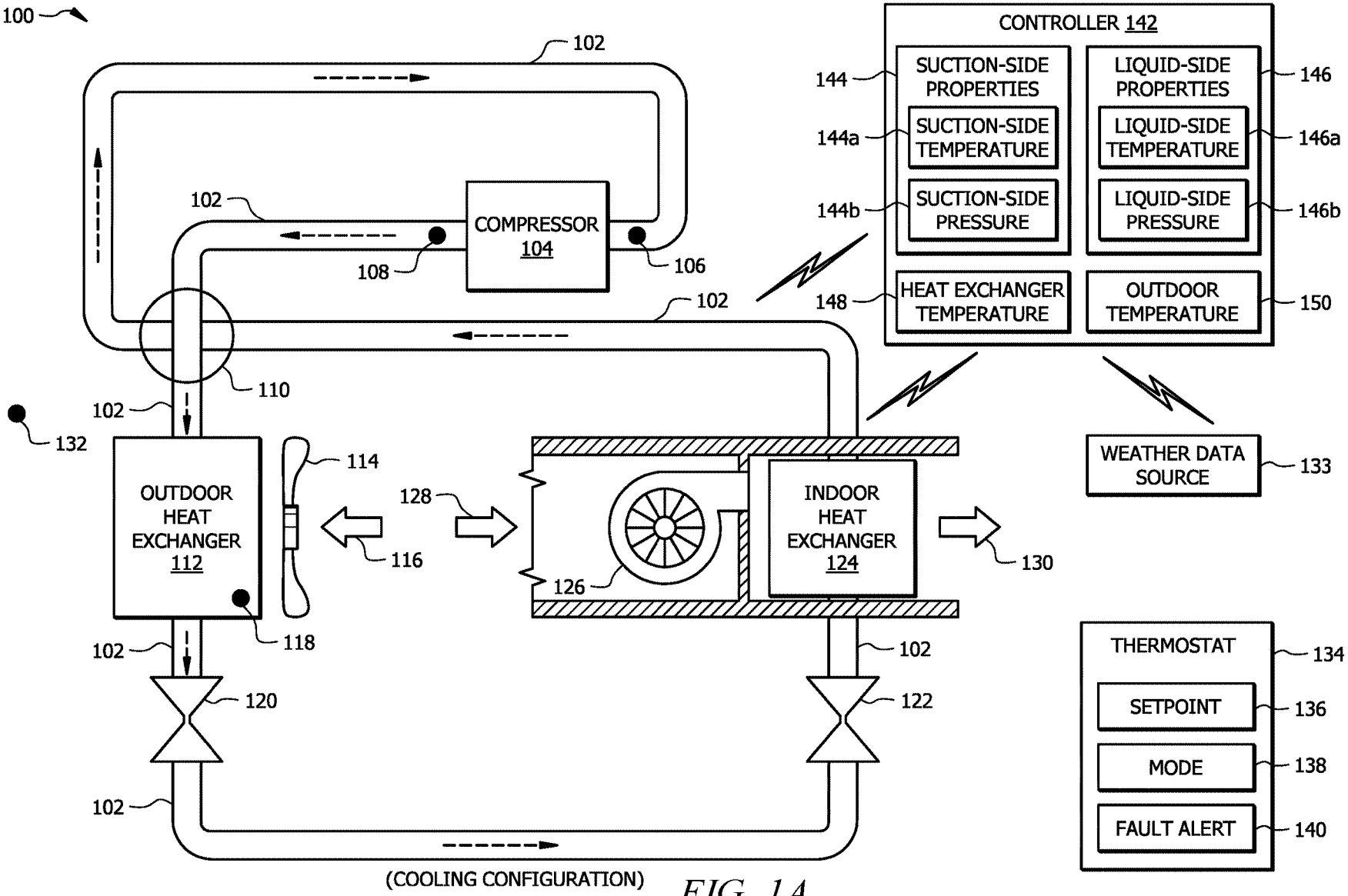
FIG. 1A is a diagram of an example HVAC system configured to operate in a cooling mode with the reversing valve in a cooling configuration.
Figure 1B:
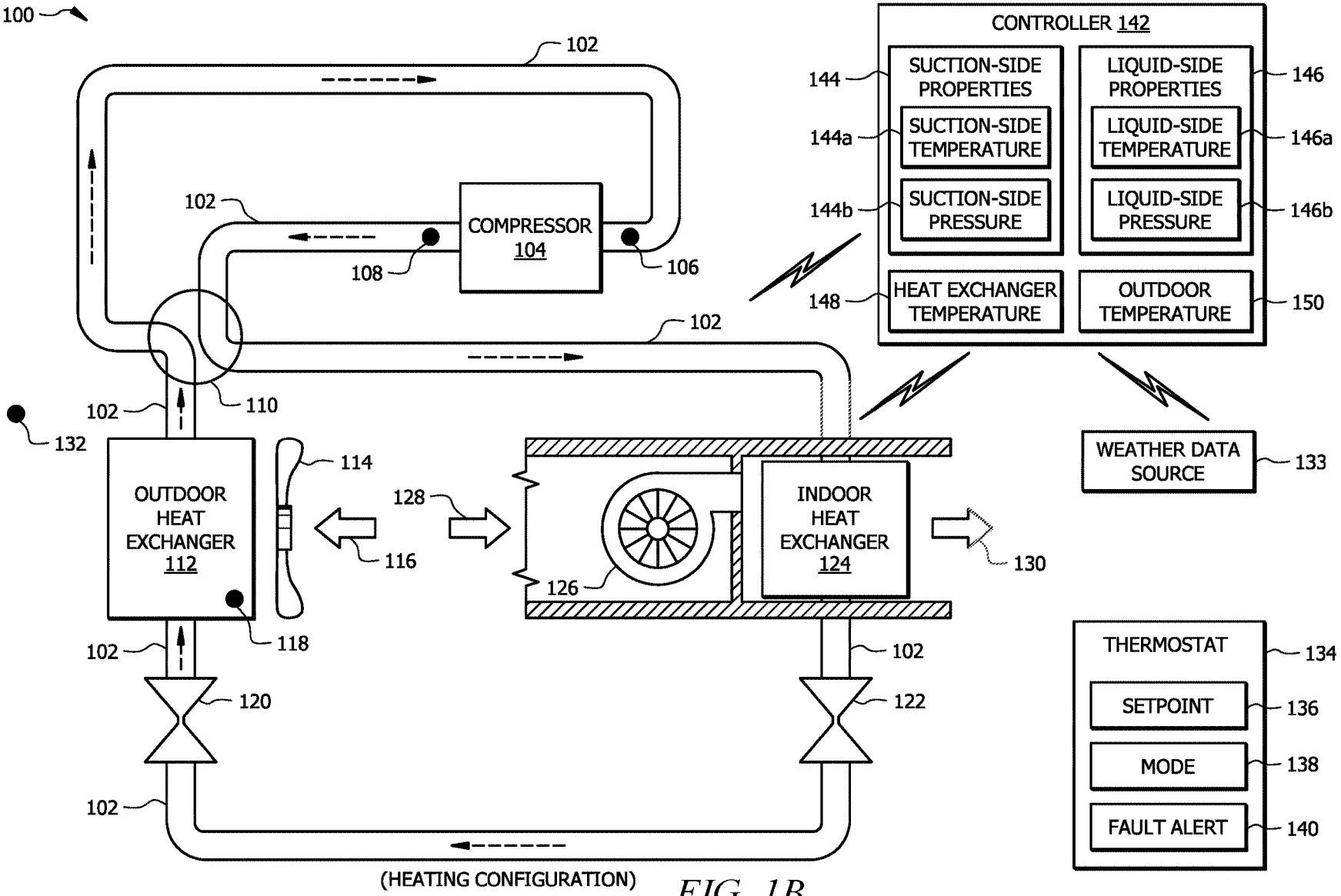
FIG. 1B is a diagram of an example HVAC system configured to operate in a heating mode with the reversing valve in a heating configuration.
Figure 1C:
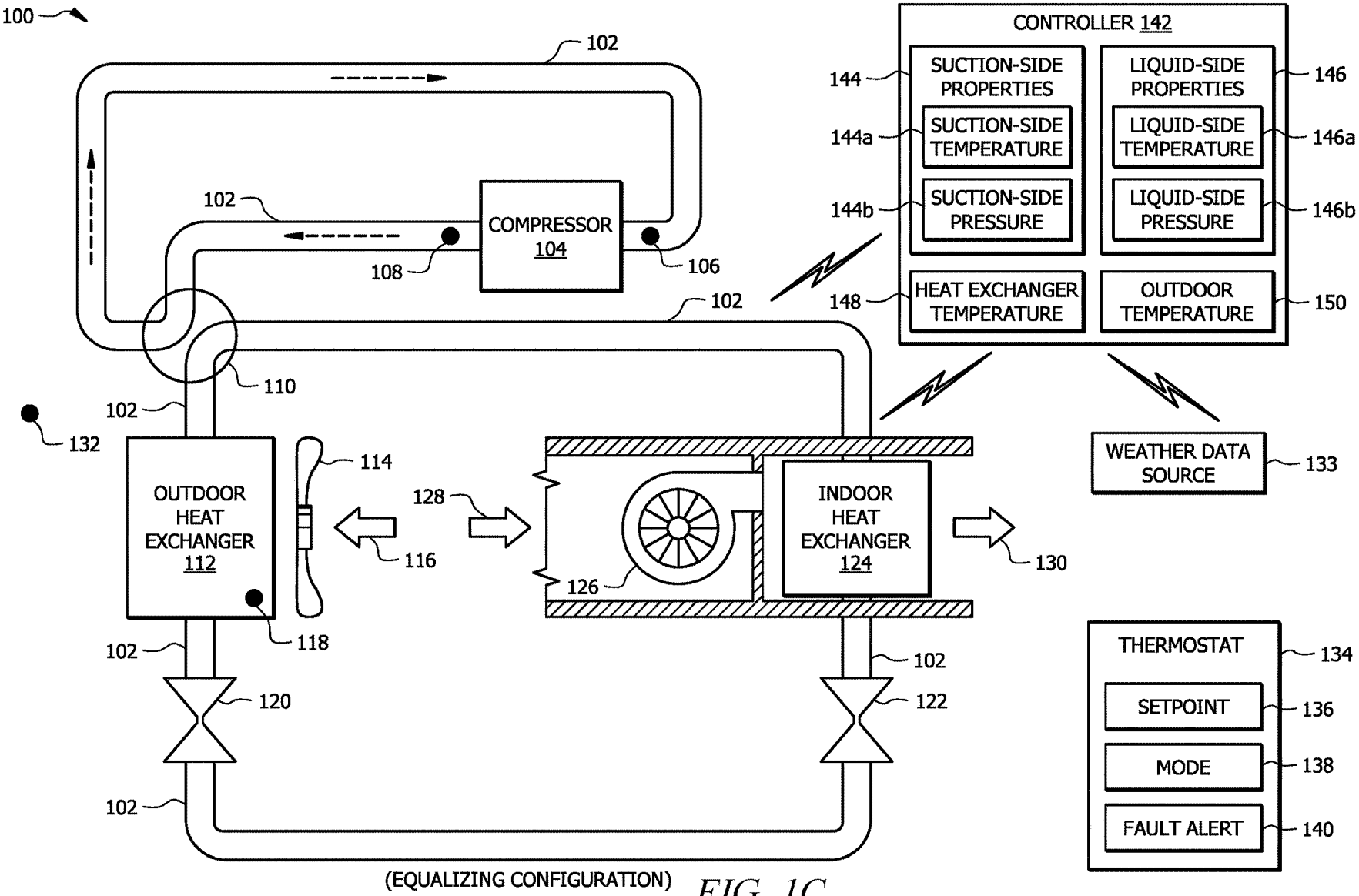
FIG. 1C is a diagram of an example HVAC system with the reversing valve in an equalizing configuration.

FIGS. 1A-C are schematic diagrams of an example HVAC system 100. The HVAC system 100 conditions air for delivery to a conditioned space. The conditioned space may be, for example, a room, a house, an office building, a warehouse, or the like. The HVAC system 100 may be configured as shown in FIGS. 1A-C or in any other suitable configuration. For example, the HVAC system 100 may include additional components or may omit one or more components shown in FIG. 1. The HVAC system 100 includes a refrigerant conduit subsystem 102, a compressor 104, an outdoor heat exchanger 112, a heating expansion device 120, a cooling expansion device 122, an indoor heat exchanger 124, a thermostat 134, and a controller 142. The controller 142 is configured to detect and diagnose a fault or malfunction of the reversing valve 110. For example, the HVAC system 100 may be configured for the determination of whether a fault of the reversing valve 110 is: (1) associated with the reversing valve 110 being in the wrong configuration for a given operating mode 138 (e.g., with the reversing valve 110 being in the cooling configuration illustrated in FIG. 1A when the HVAC system 100 is operating in a heating mode, or vice versa), or (2) associated with the reversing valve 110 being stuck in the equalizing configuration illustrated in FIG. 1 (e.g., when a heating or cooling operating mode 138 is desired).

The refrigerant conduit subsystem 102 facilitates the movement of a refrigerant through the cooling cycle of FIG. 1A, the heating cycle of FIG. 1B, or the equalizing cycle of FIG. 1C, such that the refrigerant flows as illustrated by the dashed arrows. The refrigerant may be any acceptable refrigerant including, but not limited to, fluorocarbons (e.g. chlorofluorocarbons), ammonia, non-halogenated hydrocarbons (e.g. propane), hydroflurocarbons (e.g. R-410A), or any other suitable type of refrigerant.

The compressor 104 is coupled to the refrigerant conduit subsystem 102 and compresses (i.e., increases the pressure of) the refrigerant. The compressor 104 may be a variable speed or multi-stage compressor. A variable speed compressor is generally configured to operate at different speeds to increase the pressure of the refrigerant to keep the refrigerant moving along the refrigerant conduit subsystem 102. If compressor 104 is a variable speed compressor, the speed of compressor 104 can be modified to adjust the cooling or heating capacity of the HVAC system 100. Meanwhile, a multi-stage compressor may include multiple compressors, each configured to operate at a constant speed to increase the pressure of the refrigerant to keep the refrigerant moving along the refrigerant conduit subsystem 102. In the multi-stage compressor configuration, one or more compressors can be turned on or off to adjust the cooling and/or heating capacity of the HVAC system 100.

The compressor 104 is in signal communication with the controller 142 using a wired and/or wireless connection. The controller 142 provides commands or signals to control operation of the compressor 104 and/or receives signals from the compressor 104 corresponding to a status of the compressor 104. For example, when the compressor 104 is a variable speed compressor, the controller 142 may provide a signal to control the compressor speed. When the compressor 104 is a multi-stage compressor, a signal from the controller 142 may provide an indication of the number of compressors to turn on and off to adjust the compressor 104 for a given cooling or heating capacity. The controller 142 may operate the compressor 104 in different modes 138 corresponding to a user request (e.g., for heating or cooling) and/or load conditions (e.g., the amount of cooling or heating requested by the thermostat 134). The controller 142 is described in greater detail below with respect to FIG. 4.

One or more suction-side sensors 106 is generally positioned and configured to measure suction-side properties 144 associated with refrigerant provided to an inlet of the compressor 104. The suction-side properties 144 may include a suction-side temperature 144*a* (i.e., the temperature of refrigerant flowing into the compressor 104) and a suction-side pressure 144*b* (i.e., the pressure of refrigerant flowing into the compressor 104). The suction-side sensor(s) 106 may be located in, on, or near the inlet of the compressor 104 to measure properties of the refrigerant flowing into the compressor 104. The suction-side sensor(s) 106 are in signal communication with the controller 142 via wired and/or wireless connection and are configured to provide the suction-side properties 144 to the controller 142, as illustrated in FIGS. 1A-C. The suction-side properties 144 are generally provided as an electronic signal that is interpretable by the controller 142. For example, the suction-side sensor(s) 106 may provide an indication of the suction-side properties 144 (e.g., a current or voltage proportional to the measured suction-side properties 144) or may provide a signal which may be used by the controller 142 to calculate the suction-side properties 144. The examples of FIGS. 1A-C illustrate the suction-side sensor(s) 106 positioned in the refrigerant conduit subsystem 102 proximate to the inlet of the compressor 104. However, it should be understood that the suction-side sensor(s) 106 may be positioned in any other appropriate position (e.g., in the inlet of the compressor 104 or further upstream of the inlet of the compressor 104).

One or more liquid-side sensors 108 are generally positioned and configured to measure a liquid-side properties 146 associated with refrigerant provided from an outlet of the compressor 104. The liquid-side properties 146 may include a liquid-side temperature 146*a* (i.e., the temperature of refrigerant flowing out of the compressor 104) and a liquid-side pressure 146*b* (i.e., the pressure of refrigerant flowing out of the compressor 104). The liquid-side sensor (s) 108 may be located in, on, or near the outlet of the compressor 104 to measure properties of the refrigerant flowing out of the compressor 104 (e.g., in a compressed, liquid form). The liquid-side sensor(s) 108 are in signal communication with the controller 142 via wired and/or wireless connection and are configured to provide the liquid-side property 146 to the controller 142, as illustrated in FIGS. 1A-C. Similarly to the suction-side properties 144, the liquid-side properties 146 is generally provided as an electronic signal that is interpretable by the controller 142. For example, the liquid-side sensor(s) 108 may provide an indication of the liquid-side property 146 (e.g., a current or voltage proportional to the measured liquid-side property 146) or may provide a signal which may be used by the controller 142 to calculate the liquid-side property 146. The examples of FIGS. 1A-C illustrate the liquid-side sensor(s) 108 positioned in the refrigerant conduit subsystem 102 proximate to the outlet of the compressor 104. However, it should be understood that the liquid-side sensor(s) 108 may be positioned in any other appropriate position (e.g., in the outlet of the compressor 104 or further downstream from the outlet of the compressor 104). For instance, in some embodiments, the liquid-side sensor(s) 108 is located nearer the inlet of the outdoor heat exchanger 112.

The reversing valve 110 is fluidically connected to the compressor 104, outdoor heat exchanger 112 and indoor heat exchanger 124. The reversing valve 110 is generally any valve which may be adjusted to the different configurations illustrated in FIGS. 1A-C. The reversing valve 110 facilitates operation of the HVAC system 100 as a heat pump to provide cooling to the conditioned space in the configuration illustrated in FIG. 1A and heating to the conditioned space in the configuration illustrated in FIG. 1B. In FIG. 1A, the reversing valve 110 is in a cooling configuration for operating the HVAC system 100 in a cooling operating mode 138. In FIG. 1B, the reversing valve 110 is in a heating configuration for operating the HVAC system 100 in a heating operating mode 138. In FIG. 1C, the reversing valve 110 is in an equalizing configuration where refrigerant from the outlet of compressor 104 is routed to the inlet of the compressor 104 without passing through other components of the HVAC system 100 that are associated with the refrigeration cycle (i.e., the outdoor heat exchanger 112, expansion valve(s) 120, 122, and indoor heat exchanger 124).

The outdoor heat exchanger 112 is configured to facilitate movement of the refrigerant through the refrigerant conduit subsystem 102. The outdoor heat exchanger 112 is generally configured to act as a condenser (e.g., to cool and condense refrigerant passing therethrough) when the HVAC system 100 is in the cooling configuration illustrated in FIG. 1A and to act as an evaporator (e.g., to heat refrigerant passing therethrough) when the HVAC system 100 is in the heating configuration illustrated in FIG. 1B. The fan 114 is configured to move air 116 across the outdoor heat exchanger 112. For example, the fan 114 may be configured to blow outside air through the outdoor heat exchanger 112 to help cool the refrigerant flowing therethrough for the cooling configuration of FIG. 1A or to help heat the refrigerant flowing therethrough for the heating configuration of FIG. 1B.

One or more sensors 118 are generally located in, on, or near the outdoor heat exchanger 112 to measure a temperature 148 of the refrigerant associated with the outdoor heat exchanger 112. In certain embodiments, sensor(s) 118 are positioned and configured to measure temperature(s) 148 of refrigerant flowing into, through, and/or out of the outdoor heat exchanger 112. The sensor(s) 118 are in signal communication with the controller 142 using a wired and/or wireless connection and are configured to send measured temperature 148 to the controller 142. For example, the sensor(s) 118 may provide a direct indication of the temperature 148 (e.g., a current or voltage proportional to the measured subcool value) or may be used by the controller 142 to calculate the temperature 148 (e.g., based on a signal provided by the sensor(s) 118).

When the reversing valve 110 is in the cooling configuration illustrated in FIG. 1A, refrigerant flows from the outdoor heat exchanger 112 toward a cooling expansion device 122. In the cooling configuration of FIG. 1A, the heating expansion device 120 is generally maintained in a fully open position. The cooling expansion device 122 is coupled to the refrigerant conduit subsystem 102 downstream of the outdoor heat exchanger 112 and is configured to remove pressure from the refrigerant before the refrigerant is provided to the indoor heat exchanger 124. Meanwhile, when the reversing valve 110 is in the heating configuration illustrated in FIG. 1B, refrigerant flows from the indoor heat exchanger 124 toward the heating expansion device 120. In the heating configuration of FIG. 1B, the cooling expansion device 122 is generally maintained in a fully open position. The heating expansion device 120 is coupled to the refrigerant conduit subsystem 102 downstream of the indoor heat exchanger 124 and is configured to remove pressure from the refrigerant before the refrigerant is provided to the outdoor heat exchanger 112. When the reversing valve 110 is in the equalizing configuration of FIG. 1C, refrigerant generally does not flow through the portions of the refrigerant conduit subsystem 102 that are fluidically connected to the outdoor heat exchanger 112 and the indoor heat exchanger 124.

In general, each of the heating expansion device and the cooling expansion device 122 may be a valve such as an expansion valve or a flow control valve (e.g., a thermostatic expansion valve (TXV)) or any other suitable valve for removing pressure from the refrigerant while, optionally, providing control of the rate of flow of the refrigerant. Each of the heating expansion device 120 and the cooling expansion device 122 may be in communication with the controller 142 (e.g., via wired and/or wireless communication) to receive control signals for opening and/or closing associated valves and/or provide flow measurement signals corresponding to the rate of refrigerant flowing through the refrigerant subsystem 102.

The outdoor heat exchanger 124 is generally any heat exchanger configured to provide heat transfer between air flowing through the outdoor heat exchanger 124 (i.e., contacting an outer surface of one or more coils of the outdoor heat exchanger 124) and refrigerant passing through the interior of the outdoor heat exchanger 124. The outdoor heat exchanger 124 is fluidically connected to the compressor 104, such that refrigerant flows in the cooling configuration of FIG. 1A from the indoor heat exchanger 124 to the compressor 104 via the reversing valve 110 (see dashed arrows in FIG. 1A). In the heating configuration of FIG. 1B, refrigerant flows, via the reversing valve 110, from the compressor 104 to the indoor heat exchanger 124 (see dashed arrows in FIG. 1B).

A blower 126 causes return air 128 to move across the indoor heat exchanger 124, such that heat transfer occurs between refrigerant passing through the indoor heat exchanger 124 and the flow of air 128. The blower 126 directs the resulting conditioned air 130 into the conditioned space. In the cooling configuration of FIG. 1A, the return air 128 is cooled by the indoor heat exchanger 124 and provided to the conditioned space as a cooled conditioned air 130. In the heating configuration of FIG. 1B, the return air 128 is heated by the indoor heat exchanger 124 and provided to the conditioned space as heated conditioned air 130. The blower 126 is any mechanism for providing a flow of air through the HVAC system 100. For example, the blower 126 may be a constant-speed or variable-speed circulation blower or fan. Examples of a variable-speed blower include, but are not limited to, belt-drive blowers controlled by inverters, direct-drive blowers with electronic commuted motors (ECM), or any other suitable types of blowers. The blower 126 is in signal communication with the controller 142 using any suitable type of wired and/or wireless connection. The controller 142 is configured to provide commands or signals to the blower 126 to control its operation. For example, the controller 142 may be configured to signal(s) to the blower 126 to control the speed of the blower 126 and/or to receive signals associated with a speed and/or status of the blower 126.

The HVAC system 100 includes one or more outdoor temperature sensors 132 in signal communication with the controller 142. The outdoor temperature sensor(s) 132 provide an outdoor temperature 150 to the controller 142. The outdoor temperature 150 is generally provided as an electronic signal that is interpretable by the controller 142. For example, the outdoor temperature sensor(s) 132 may provide an indication of the outdoor temperature 150 (e.g., a current or voltage proportional to the measured outdoor temperature 150) or may provide a signal which may be used by the controller 142 to calculate the outdoor temperature 150. In some embodiments, the outdoor temperature 150 may be provided and/or determined from information provided by a weather data source 133. For example, the weather data source 133 may provide current and/or forecast weather information, which includes historical, current, and/or forecast measurements of the outdoor temperature 150. The HVAC system 100 may include one or more additional sensors (not shown for clarity and conciseness) to measure other properties of the conditioned space, the HVAC system 100, and/or the surrounding environment. These sensors may include any suitable sensor positioned and configured to measure air temperature and/or any other property(ies) of the conditioned space, the HVAC system 100, and/or the surrounding environment.

The HVAC system 100 includes one or more thermostats 134, for example located within the conditioned space (e.g. a room or building). The thermostat 134 is generally in signal communication with the controller 142 using any suitable type of wired and/or wireless communications. The thermostat 134 may be a single-stage thermostat, a multi-stage thermostat, or any suitable type of thermostat. The thermostat 134 is configured to allow a user to input a desired temperature or temperature setpoint 136 for a designated space or zone such as a room in the conditioned space. The controller 142 may use information from the thermostat 134 such as the temperature setpoint 136 for controlling the compressor 104, the reversing valve 110, the fan 114, and/or the blower 126.

The thermostat may provide for display and/or input of an operating mode 138 of the HVAC system 100. For example, the operating mode 138 may be a cooling operating mode or a heating operating mode. For instance, when the operating mode 138 is a cooling operating mode, the reversing valve 110 should be configured such that the flow of refrigerant proceeds through the refrigerant conduit subsystem 102 according to the cooling configuration of FIG. 1A. When the operating mode 138 is a heating operating mode, the reversing valve 110 should be configured such that the flow of refrigerant proceeds through the refrigerant conduit subsystem 102 according to the heating configuration of FIG. 1B. As described elsewhere in this disclosure, in some cases, the reversing valve 110 may malfunction such that the actual configuration of the HVAC system 100 (i.e., as illustrated in FIGS. 1A-C), may not correspond to the operating mode 138 of the HVAV system 100. For example, the thermostat 134 may indicate that the HVAC system 100 should be operating in a cooling mode 138, but the reversing valve 110 may be incorrectly positioned such that refrigerant flows according to the heating configuration of FIG. 1B or the equalizing configuration of FIG. 1C. As described in greater detail below with respect to FIGS. 2 and 3, the controller 142 is configured to determine if such a malfunction of the reversing valve 110 has occurred and distinguish between types of malfunctions of the valve 110.

In some embodiments, the thermostat 134 includes a user interface for displaying information related to the operation and/or status of the HVAC system 100. For example, the user interface may display operational, diagnostic, and/or status messages and provide a visual interface that allows at least one of an installer, a user, a support entity, and a service provider to perform actions with respect to the HVAC system 100. For example, the user interface may provide for input of the temperature setpoint 136, display and/or input of the mode 138, and display of any fault alerts 140 related to the status and/or operation of the HVAC system 100. A fault alert 140 may be associated with a determination that the reversing valve 110 is not in an appropriate configuration for a given mode 138, as described above and in greater detail below with respect to FIGS. 2 and 3.

As described in greater detail below, the controller 142 is configured to (1) store measurements of the suction-side properties 144, liquid-side properties 146, heat exchanger temperature 148, and outdoor temperature 150; (2) use this information to detect and diagnose a fault of the reversing valve 110; and (3) provide an appropriate fault alert 140. For instance, in some embodiments, the controller 142 monitors the heat exchanger temperature 148 and outdoor temperature 150 and uses this information to detect and diagnose a malfunction of the reversing valve 110 (e.g., to detect when the reversing valve 110 is in the wrong position for providing heating or cooling as described in greater detail below with respect to FIG. 2). In some embodiments, the controller 142 monitors the suction-side properties 144 and liquid-side properties 146 and uses this information to detect and diagnose a malfunction of the reversing valve 110 (e.g., to detect when the reversing valve 110 is stuck in the equalizing position associated with the configuration illustrated in FIG. 1C, as described in greater detail below with respect to FIG. 3). The controller 142 is described in greater detail below with respect to FIG. 4.

As described above, in certain embodiments, connections between various components of the HVAC system 100 are wired. For example, conventional cable and contacts may be used to couple the controller 142 to the various components of the HVAC system 100, including, the compressor 104, sensors 106, 108, 118, 132, the reversing valve 110, the fan 114, the blower 126, and thermostat(s) 134. In some embodiments, a wireless connection is employed to provide at least some of the connections between components of the HVAC system 100. In some embodiments, a data bus couples various components of the HVAC system 100 together such that data is communicated therebetween. In a typical embodiment, the data bus may include, for example, any combination of hardware, software embedded in a computer readable medium, or encoded logic incorporated in hardware or otherwise stored (e.g., firmware) to couple components of HVAC system 100 to each other. As an example and not by way of limitation, the data bus may include an Accelerated Graphics Port (AGP) or other graphics bus, a Controller Area Network (CAN) bus, a front-side bus (FSB), a HYPERTRANS PORT (HT) interconnect, an INFINIB AND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus may include any number, type, or configuration of data buses, where appropriate. In certain embodiments, one or more data buses (which may each include an address bus and a data bus) may couple the controller 142 to other components of the HVAC system 100.

In an example operation of HVAC system 100, the system 100 starts up to provide cooling to an enclosed space. For example, the controller 142 may determine whether to operate in the cooling configuration of FIG. 1A or the heating configuration of FIG. 1B based on the current operating mode 138 and a comparison of an indoor temperature to the temperature setpoint 136. For instance, if a cooling operating mode 138 is indicated and the indoor temperature is greater than the temperature setpoint 136, the controller 142 may request that the reversing valve 110 be adjusted to the cooling configuration of FIG. 1A, and the compressor 104, fan 114, and blower 126 may begin operating to provide cooled conditioned air 130 to the space. Likewise, if a heating operating mode 138 is indicated and the indoor temperature is less than the temperature setpoint 136, the controller 142 may request that the reversing valve 110 be adjusted to the heating configuration of FIG. 1B, and the compressor 104, fan 114, and blower 126 may begin operating to provide heated conditioned air 130 to the space.

If the reversing valve 110 is not operating as intended (e.g., is experiencing a fault or malfunction), the reversing valve 110 may be in an incorrect configuration for achieving cooling or heating. In order to detect such a malfunction and determine the type of malfunction (i.e., whether the reversing valve is in the wrong configuration for heating or cooling or if the reversing valve 110 is stuck in the equalizing configuration of FIG. 1C), the controller 142 monitors the suction-side properties 144, liquid-side properties 146, heat exchanger temperature 148, and outdoor temperature 150 and uses this information to detect a fault and provide a corresponding fault alert 140. The controller 142 may further stop operation of the HVAC system 100 (e.g., by shutting down the compressor 104, fan 114, and/or blower 126), such that damage to the HVAC system 100 and/or unnecessary expenditure of energy is prevented before the fault or malfunction of the reversing valve 110 is corrected.

For example, the controller 142 may compare values of the heat exchanger temperature 148 and outdoor temperature 150 in order to detect a first example valve-fault scenario where the reversing valve 110 is in the heating configuration of FIG. 1B when a cooling operating mode 138 is indicated by thermostat 134. For instance, if a cooling operating mode 138 is indicated and the controller 142 detects that the heat exchanger temperature 148 is less than the outdoor temperature, then a fault of the reversing valve 110 is detected and a corresponding alert 140 is provided. A similar approach may be used to detect a second example scenario where the reversing valve 110 is in the cooling configuration of FIG. 1B when a heating operating mode 138 is indicated. In this second scenario, a fault is detected and reported if a heating operating mode 138 is indicated and the heat exchanger temperature 148 is greater than the outdoor temperature 150. The determination of faults associated with these first and second example scenarios is described in greater detail below with respect to FIG. 2.

The controller 142 may monitor values of the suction-side properties 144 and liquid-side properties 146 in order to detect a third example scenario where the reversing valve 110 is stuck in the equalizing configuration of FIG. 1C. In the equalizing configuration of FIG. 1C, rather than passing refrigerant through the refrigeration cycle (e.g., either for heating or cooling) associated with the outdoor heat exchanger 112, expansion devices 120, 122, and indoor heat exchanger 124, the refrigerant provided from the outlet of the compressor 104 is directed to the inlet of the compressor 104. For example, the controller 142 may determine that a suction-side temperature 144*a* is greater than a liquid-side temperature 146*a* and, in response, determine that the reversing valve 110 is stuck in the equalizing configuration of FIG. 1C. As another example, the controller 142 may determine that a ratio of a liquid-side pressure 146*b* to a suction-side pressure 144*b* is less than a threshold value. For example, the threshold value may be 1.2. In response, the controller may determine whether the suction-side temperature 144*a* has an increasing trend. If both the ratio of the liquid-side pressure 146*b* to the suction-side pressure 144*b* is less than the threshold value and the suction-side temperature 144*a* has an increasing trend, the controller 142 may determine that the reversing valve 110 is stuck in the equalizing configuration of FIG. 1C. Detection and diagnosis of the reversing valve 110 being stuck in the equalizing configuration of FIG. 1C is described in greater detail below with respect to FIG. 3.

Example Method of Detecting a Reversing Valve Fault

Figure 2:
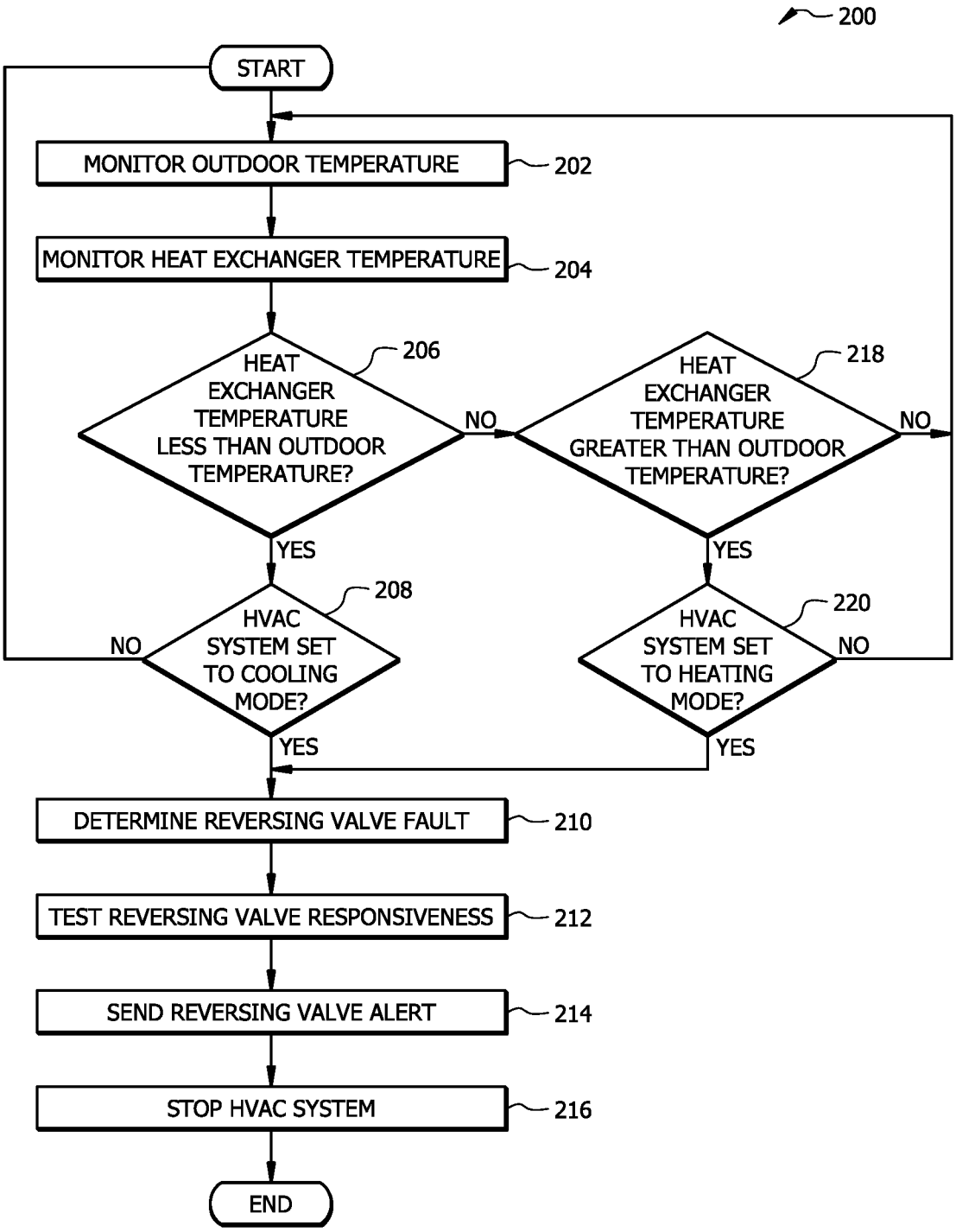
FIG. 2 is a flowchart illustrating an example method of detecting a fault associated with the reversing valve of the HVAC system of FIGS. 1A-C.

FIG. 2 is a flowchart of an example method 200 of operating the HVAC system 100 of FIGS. 1A-C for detection a fault of the reversing valve 110. The method 200 facilitates the detecting and diagnosis of a fault of the reversing valve 110 in which the valve 110 is in the wrong configuration for a desired mode 138. For example, the method 200 may be used to detect that the reversing valve 110 is configured in the cooling configuration of FIG. 1A when a heating operating mode 138 is indicated by the thermostat 134, and/or that the reversing valve 110 is configured according to the heating configuration of FIG. 1B when a cooling operating mode 138 is indicated by the thermostat 134.

Method 200 may begin at step 202 where the outdoor temperature 150 is monitored. For example, the controller 142 may receive the outdoor temperature 150 from the outdoor temperature sensor(s) 132 and/or the weather data source 133 intermittently (e.g., several times per second, each second, or the like) and store measurements of the outdoor temperature 150. At step 204, the heat exchanger temperature 148 is monitored. For example, the controller 142 may receive the heat exchanger temperature 148 from the heat exchanger temperature sensor(s) 118 intermittently (e.g., several times per second, each second, or the like) and store measurements of the heat exchanger temperature 148.

At step 206, the controller 142 determines whether the heat exchanger temperature 148 is less than the outdoor temperature 150. For example, the controller may determine a difference between the heat exchanger temperature 148 and the outdoor temperature 150. If this difference is less than zero, the controller 142 may determine that the heat exchanger temperature 148 is less than the outdoor temperature 150. In some embodiments, the difference may be compared to a threshold value (e.g., a threshold of the thresholds 408 described with respect to FIG. 4 below), and, in order for the heat exchanger temperature 148 to be considered less than the outdoor temperature 150, the difference must be less than (e.g., more negative than) the threshold value. In some embodiments, the criteria of step 206 must be satisfied for at least a minimum time interval (e.g., of at least 30 seconds, e.g., of at least one minute, e.g., of at least five minutes) in order for the heat exchanger temperature 148 to be considered less than the outdoor temperature 150. If, at step 206, the heat exchanger temperature 148 is less than the outdoor temperature 150, the controller 142 proceeds to step 208. Otherwise, if the heat exchanger temperature 148 is not less than the outdoor temperature 150, the controller 142 proceeds to step 218.

At step 208, the controller 142 determines whether the HVAC system 100 is set to a cooling operating mode 138. As described above, during normal operation in a cooling operating mode 138, the HVAC system should be configured according to the cooling configuration illustrated in FIG. 1A. If the HVAC system 100 is not set to a cooling operating mode 138, then no fault or malfunction is detected, and the controller 142 returns to steps 202 and 204 to monitor the outdoor temperature 150 and the heat exchanger temperature 148, respectively. However, if the HVAC system 100 is set to operate in a cooling operating mode 138 at step 208, the controller 142 proceeds to step 210.

At step 210, the controller 142 determines that a reversing valve fault is detected. In some embodiments, prior to determining that the reversing valve fault is detected, the controller 142 first confirms that the HVAC system 100 is operating (e.g., that there is either a current heating or cooling demand). In other words, the controller 142 may confirm that the HVAC system 100 as a prerequisite to determining that the reversing valve fault is detected. In this example case, the controller 142 has detected that the relative values of the outdoor temperature 150 and the heat exchanger temperature 148 are inconsistent with normal operation of the HVAC system 100 in the cooling configuration illustrated in FIG. 1A and that the HVAC system 100 is instead configured (incorrectly) according to the heating configuration of FIG. 1B. In other words, the reversing valve 110 is determined to be in the wrong position or configuration for providing cooling in the desired cooling operating mode 138.

At step 212, the controller 142 may test the responsiveness of the reversing valve 110. This test may involve providing a signal to the reversing valve 110 which instructs the reversing valve 110 to change from the heating mode configuration of FIG. 1B to the appropriate cooling mode configuration of FIG. 1A. Following provision of this test signal, the controller 142 may wait a predetermined time interval (e.g., 30 seconds, one minute, five minutes, or the like) before determining whether the criteria of steps 206 and 208 are still satisfied. If the criteria of steps 206 and 208 are still satisfied, the test fails, and the controller proceeds to step 214. Otherwise, if the criteria of steps 206 and 208 are no longer satisfied, the controller 142 may determine that the reversing valve fault has been corrected. The controller 142 may still proceed to step 214 to report the detected fault such that inspection and/or appropriate preventative maintenance may be performed on the reversing valve 110.

At step 214, the controller 142 sends a reversing valve fault alert 140 for presentation on the thermostat 134. For example, the fault alert 140 may indicate that the reversing valve 110 is in the heating configuration of FIG. 1B rather than the appropriate cooling configuration of FIG. 1A for the currently requested cooling operating mode 138. In some embodiments, the alert 140 may also or alternatively be provided to a third-party (e.g., an administrator or maintenance provider of the HVAC system 100). This may facilitate the more rapid correction of the fault or malfunction of the reversing valve 110. At step 216, the controller 142 may stop operation of the HVAC system 100. For example, the controller 142 may cause the compressor 104 to stop operating (e.g., to shut off). The controller 142 may also cause one or both of the fan 114 and the blower 126 stop operating (e.g., shut off). Stopping operation of the HVAC system 100 may prevent damage to the HVAC system 100.

As described above, if, at step 206, the heat exchanger temperature 148 is not less than the outdoor temperature 150, the controller 142 proceeds to step 218. At step 218, the controller 142 determines whether the heat exchanger temperature 148 is greater than the outdoor temperature 150. For example, the controller 142 may determine a difference between the heat exchanger temperature 148 and the outdoor temperature 150. If this difference is greater than zero, the controller 142 may determine that the heat exchanger temperature 148 is greater than the outdoor temperature 150. In some embodiments, the difference may be compared to a threshold value (e.g., a threshold of the thresholds 408 described with respect to FIG. 4 below), and, in order for the heat exchanger temperature 148 to be considered greater than the outdoor temperature 150, the difference must be greater than (e.g., more positive than) the threshold value. In some embodiments, the criteria of step 218 must be satisfied for at least a minimum time interval (e.g., of at least 30 seconds, e.g., of at least one minute, e.g., of at least five minutes) in order for the outdoor temperature 150 to be considered less than the outdoor temperature 150. If, at step 218, the heat exchanger temperature 148 is greater than the outdoor temperature 150, the controller 142 proceeds to step 220. Otherwise, if the heat exchanger temperature 148 is not greater than the outdoor temperature 150, the controller 142 returns to steps 202 and 204 to monitor the outdoor temperature 150 and heat exchanger temperature 148, respectively.

At step 220, the controller 142 determines whether the HVAC system 100 is set to a heating operating mode 138. As described above, during normal operation in a heating operating mode 138, the HVAC system 100 should be configured according to the cooling configuration illustrated in FIG. 1B. If the HVAC system 100 is not set to a heating operating mode 138, then no fault or malfunction is detected, and the controller 142 returns to steps 202 and 204 to monitor the outdoor temperature 150 and the heat exchanger temperature 148, respectively. However, if the HVAC system 100 is set to operate in a heating operating mode 138 at step 220, the controller 142 proceeds to step 210.

As described above, at step 210, the controller 142 determines that a reversing valve fault is detected. In this example case, the controller 142 has detected that the relative values of the outdoor temperature 150 and the heat exchanger temperature 148 are inconsistent with normal operation of the HVAC system 100 in the heating configuration illustrated in FIG. 1B and that the HVAC system 100 is instead configured (incorrectly) according to the cooling configuration of FIG. 1A. In other words, the reversing valve 110 is determined to be in the wrong position or configuration for providing heating in the desired heating operating mode 138.

As described above, at step 212, the controller 142 may test the responsiveness of the reversing valve 110. This test may involve providing a signal to the reversing valve 110 which instructs the reversing valve 110 to change from the cooling mode configuration of FIG. 1A to the appropriate heating mode configuration of FIG. 1B. Following provision of this test signal, the controller 142 may wait a predetermined time interval (e.g., 30 seconds, one minute, five minutes, or the like) before determining whether the criteria of steps 218 and 220 are still satisfied. If the criteria of steps 218 and 220 are still satisfied, the test fails, and the controller 142 proceeds to step 214. Otherwise, if the criteria of steps 218 and 220 are no longer satisfied, the controller 142 may determine that the reversing valve fault has been corrected. The controller 142 may still proceed to step 214 to report the detected fault such that inspection and/or appropriate preventative maintenance may be performed on the reversing valve 110.

As described above, at step 214, the controller 142 sends a reversing valve fault alert 140 for presentation on the thermostat 134. For example, the fault alert 140 may indicate that the reversing valve 110 is in the cooling configuration of FIG. 1A rather than the appropriate heating configuration of FIG. 1B for the currently requested heating operating mode 138. In some embodiments, the alert 140 may also or alternatively be provided to a third-party (e.g., an administrator or maintenance provider of the HVAC system 100). This may provide for more rapid correction of the fault or malfunction of the reversing valve 110. At step 216, the controller 142 may stop operation of the HVAC system 100. Stopping operation of the HVAC system 100 may prevent damage to the system 100.

Modifications, additions, or omissions may be made to method 200 depicted in FIG. 2. Method 200 may include more, fewer, or other steps. For example, steps may be performed in parallel or in any suitable order. While at times discussed as controller 142, HVAC system 100, or components thereof performing the steps, any suitable HVAC system 100 or components of the HVAC system 100 may perform one or more steps of the method 200.

Example Detection of a Reversing Valve Stuck in an Equalizing Configuration

Figure 3:
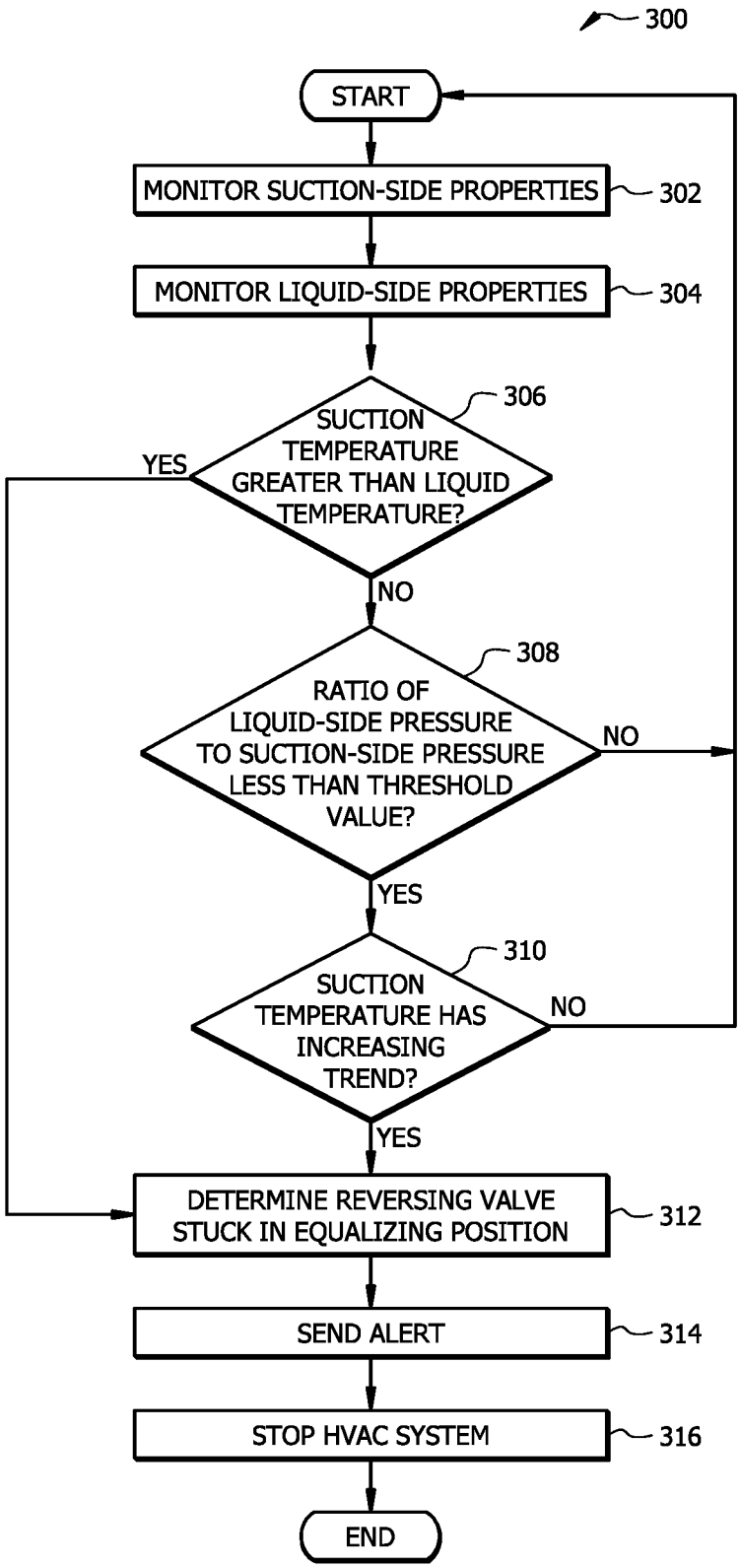
FIG. 3 is a flowchart illustrating an example method of detecting a fault associated with the reversing valve of the HVAC system of FIGS. 1A-C being stuck in the equalizing configuration illustrated in FIG. 1C.

FIG. 3 is a flowchart of an example method 300 of operating the HVAC system 100 for detecting when reversing valve 110 is stuck in the equalizing configuration illustrated in FIG. 1C. For example, the method 300 may be used to detect that the reversing valve 110 is stuck in the equalizing configuration of FIG. 1C when either the cooling configuration of FIG. 1A or the heating configuration of FIG. 1B is indicated by the current operating mode 138.

Method 300 may begin at step 302 where the suction-side properties 144 are monitored. In this example, the suction-side properties 144 include a suction-side temperature **144*a* and a suction-side pressure 144*b*. The controller 142 may receive the suction-side properties 144 from the sensor(s) 106 intermittently (e.g., several times per second, each second, or the like) and store measurements of the suction-side properties 144. At step 304, the liquid-side properties 146 are monitored. In this example, the liquid-side properties 146 include a liquid-side temperature 146*a* and a liquid-side pressure 146*b*. The controller 142 may receive the liquid-side properties 146 from the sensor(s) 108 intermittently (e.g., several times per second, each second, or the like) and store measurements of the liquid-side properties 146**.

At step 306, the controller 142 determines whether the suction-side temperature **144*a* is less than the liquid-side temperature 146*a*. For example, the controller 142 may determine a difference between the suction-side temperature 144*a* and the liquid-side temperature 146*a*. If this difference is less than zero, the controller 142 may determine that the suction-side temperature 144*a* is less than the liquid-side temperature 146*a*. In some embodiments, the difference may be compared to a threshold value (e.g., a threshold of the thresholds 408 described with respect to FIG. 4 below), and, in order for the suction-side temperature 144*a* to be considered less than the liquid-side temperature 146*a*, the difference must be less than (e.g., more negative than) the threshold value. In some embodiments, the criteria of step 306 must be satisfied for at least a minimum time interval (e.g., of at least 30 seconds, e.g., of at least one minute, e.g., of at least five minutes) in order for the suction-side temperature 144*a* to be considered less than the liquid-side temperature 146*a*. If, at step 306, the suction-side temperature 144*a* is not less than the liquid-side temperature 146*a*, the controller 142 proceeds to step 308. Otherwise, if the heat suction-side temperature 144***a* is less than the liquid-side temperature 146*a*, the controller 142 proceeds to step 312 (i.e., bypassing the other determinations associated with steps 308 and 310). In other words, the determination at step 306, based on a comparison of the suction-side temperature 144*a* and liquid-side temperature 146*a*, may be used as an initial test to determine whether the reversing valve 110 is stuck in the equalizing configuration of FIG. 1C.

At step 308, the controller 142 determines whether a ratio of the liquid-side pressure 146*b* to the suction-side pressure 144*b* is less than a threshold value (e.g., a threshold of thresholds 408 described with respect to FIG. 4 below). For example, the controller 142 may calculate a ratio of the liquid-side pressure 146*b* to the suction-side pressure 144*b* and compare the resulting ratio to a threshold value. In some embodiments, the criteria of step 308 must be satisfied for at least a minimum time interval (e.g., of at least 30 seconds, e.g., of at least one minute, e.g., of at least five minutes) in order for the ratio to be considered less than the threshold value. If the criteria of step 308 are not satisfied, the controller 142 returns to steps 302 and 304 to monitor the suction-side properties 144 and liquid-side properties 148, respectively. However, if the criteria of step 308 is satisfied, the controller 142 proceeds to step 310.

At step 310, the controller 142 determines whether the suction-side temperature 144*a* of the suction-side properties 144 has an increasing trend. For example, the controller 142 may determine whether the value of the suction-side temperature 144*a* increases during a period of time, following the determination at step 308 that the ratio of the liquid-side pressure 146*b* to the suction-side pressure 144*b* is less than the predefined threshold value. In some embodiments, a trend in the suction-side temperature 144*a* is determined based on a rate of change of the suction-side temperature 144*a* (e.g., a time derivative of stored values and/or instantaneous values of the suction-side temperature 144*a*). For example, the controller 142 may determine a rate of change of the suction-side temperature 144*a* over a period of time. The controller 142 may determine if the rate of change is positive (i.e., greater than zero) for a predefined period of time (e.g., for 30 seconds or more). In some embodiments, if the rate of change has been positive for the period of time, the controller 142 may determine that the suction-side temperature 144*a* has an increasing trend at step 310. In some embodiments, in order to determine that the suction-side temperature 144*a* has an increasing trend, the controller 142 may determine that the rate of change of the suction-side temperature 144*a* is both positive and greater than a threshold value for a minimum period of time. In some embodiments, the controller 142 may determine, for a period of time, a difference between an initial value (e.g., at the start of the period of time) of the suction-side temperature 144*a* and a final value (e.g., at the end of the period of time) of the suction-side temperature 144*a*. If this difference is greater than a threshold value (e.g., a threshold of thresholds 408 described with respect to FIG. 4 below), the controller 142 may determine that the of the suction-side temperature 144*a* has an increasing trend at step 310. If the controller 142 determines the of the suction-side temperature 144*a* does not have an increasing trend, the controller 142 returns to steps 302 and 304 to monitor the suction-side properties 144 and liquid-side properties 146, respectively. Otherwise, if the controller 142 determines that the suction-side temperature 144*a* has an increasing trend, the controller 142 proceeds to step 312.

At step 312, the controller 142 determines that a reversing valve fault is detected and that the reversing valve 110 is stuck in the equalizing configuration illustrated in FIG. 1C. In some embodiments, prior to determining that the reversing valve fault is detected, the controller 142 first confirms that the HVAC system 100 is operating (e.g., that there is either a current heating or cooling demand). In other words, the controller 142 may confirm that the HVAC system 100 as a prerequisite to determining that the reversing valve fault is detected. When the HVAC system 100 is not running (i.e., not providing heating or cooling), it may be appropriate and/or acceptable for the reversing valve 110 to be in the equalizing configuration of FIG. 1C. In some embodiments, the controller 142 may test whether the valve is responsive and can be moved out of the equalizing configuration (e.g., as described with respect to step 212 of FIG. 2 above). At step 314, the controller 142 sends a reversing valve fault alert 140 for presentation on the thermostat 134. For example, the fault alert 140 may indicate that the reversing valve 110 is stuck in the equalizing configuration of FIG. 1C. In some embodiments, the fault alert 140 may also or alternatively be provided to a third-party (e.g., an administrator or maintenance provider of the HVAC system 100). This may facilitate the more rapid correction of the fault or malfunction of the reversing valve 110. At step 316, the controller 142 may automatically stop operation of the HVAC system 100. For example, the controller 142 may cause the compressor 104 to stop operating (e.g., to shut off). The controller 142 may also cause one or both of the fan 114 and the blower 126 stop operating (e.g., shut off). Stopping operation of the HVAC system 100 may prevent damage to one or more components of the HVAC system 100 and reduce the expenditure of energy without providing desired conditioning to a space while the reversing valve 110 is stuck in the equalizing configuration of FIG. 1C.

Modifications, additions, or omissions may be made to method 300 depicted in FIG. 3. Method 300 may include more, fewer, or other steps. For example, steps may be performed in parallel or in any suitable order. While at times discussed as controller 142, HVAC system 100, or components thereof performing the steps, any suitable HVAC system 100 or components of the HVAC system 100 may perform one or more steps of the method 300.

Example Controller

Figure 4:
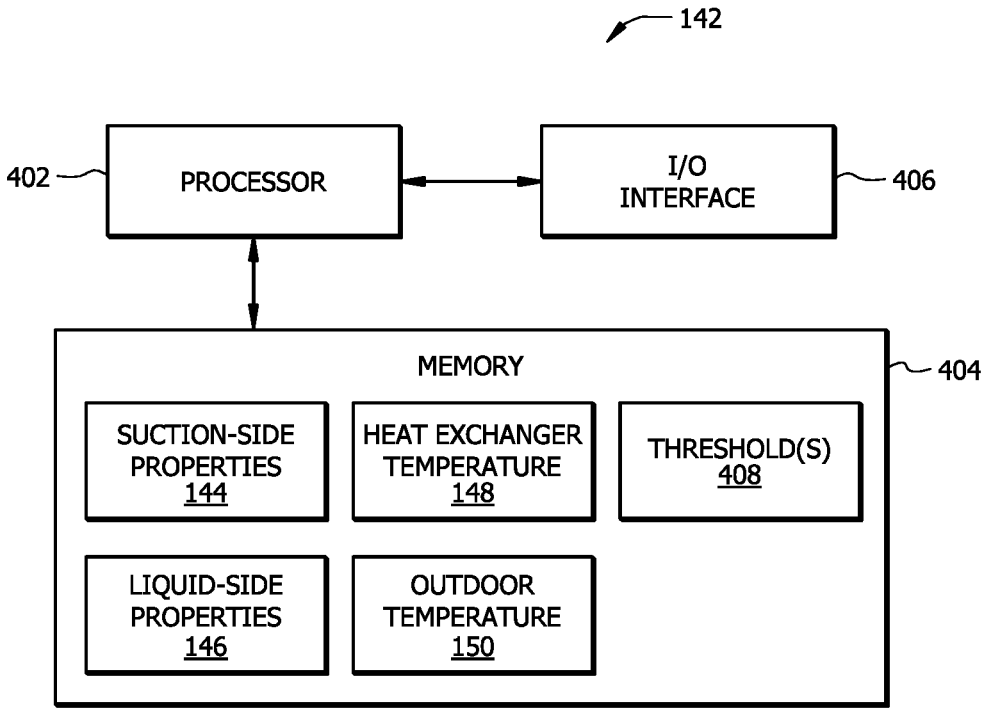
FIG. 4 is a diagram of the controller of the example HVAC system of FIGS. 1A-C.

FIG. 4 is a schematic diagram of an embodiment of the controller 142. The controller 142 includes a processor 402, a memory 404, and an input/output (I/O) interface 406.

The processor 402 includes one or more processors operably coupled to the memory 404. The processor 402 is any electronic circuitry including, but not limited to, state machines, one or more central processing unit (CPU) chips, logic units, cores (e.g. a multi-core processor), field-programmable gate array (FPGAs), application specific integrated circuits (ASICs), or digital signal processors (DSPs) that communicatively couples to memory 404 and controls the operation of HVAC system 100. The processor 402 may be a programmable logic device, a microcontroller, a microprocessor, or any suitable combination of the preceding. The processor 402 is communicatively coupled to and in signal communication with the memory 404. The one or more processors are configured to process data and may be implemented in hardware or software. For example, the processor 402 may be 8-bit, 16-bit, 32-bit, 64-bit or of any other suitable architecture. The processor 402 may include an arithmetic logic unit (ALU) for performing arithmetic and logic operations, processor registers that supply operands to the ALU and store the results of ALU operations, and a control unit that fetches instructions from memory 404 and executes them by directing the coordinated operations of the ALU, registers, and other components. The processor may include other hardware and software that operates to process information, control the HVAC system 100, and perform any of the functions described herein (e.g., with respect to FIGS. 2 and 3). The processor 402 is not limited to a single processing device and may encompass multiple processing devices. Similarly, the controller 142 is not limited to a single controller but may encompass multiple controllers.

The memory 404 includes one or more disks, tape drives, or solid-state drives, and may be used as an over-flow data storage device, to store programs when such programs are selected for execution, and to store instructions and data that are read during program execution. The memory 404 may be volatile or non-volatile and may include ROM, RAM, ternary content-addressable memory (TCAM), dynamic random-access memory (DRAM), and static random-access memory (SRAM). The memory 404 is operable to measurements of the suction-side properties 144, liquid-side properties 146, heat exchanger temperature 148, and outdoor temperature 150, threshold values 408, and any other logic or instructions associated with performing the functions described in this disclosure (e.g., described above with respect to methods 200 and 300 of FIGS. 2 and 3). The threshold values 408 generally include any of the threshold values described above with respect to the example methods 200 and 300 of FIGS. 2 and 3.

The I/O interface 406 is configured to communicate data and signals with other devices. For example, the I/O interface 406 may be configured to communicate electrical signals with components of the HVAC system 100 including the compressor 104, the suction-side sensor(s) 106, the liquid-side sensor(s) 108, the reversing valve 110, the fan 114, the heat exchanger sensor 118, the expansion devices 120, 122, the blower 126, outdoor temperature sensor 132, and the thermostat 134. The I/O interface may receive, for example, compressor signals, signals associated with any one or more of the sensors 106, 108, 118, 132, thermostat calls, temperature setpoints, environmental conditions, and an operating mode status for the HVAC system 100 and send electrical signals to the components of the HVAC system 100. The I/O interface 406 may include ports or terminals for establishing signal communications between the controller 142 and other devices. The I/O interface 406 may be configured to enable wired and/or wireless communications.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

What is claimed is:

1. A heating, ventilation and air conditioning (HVAC) system comprising:

a reversing valve configured to receive refrigerant and direct the received refrigerant based on an operating mode of the HVAC system;

a sensor positioned and configured to measure a heat-exchanger temperature associated with an outdoor heat exchanger; and a controller communicatively coupled to the sensor, the controller configured to:

receive measurements of an outdoor temperature;

monitor, based on measurements received from the sensor, the heat-exchanger temperature;

compare the outdoor temperature to the heat-exchanger temperature;

determine whether the HVAC system is intended to operate in a cooling mode or heating mode; and in response to determining that the heat-exchanger temperature is less than the outdoor temperature and that the HVAC system is intended to operate in the cooling mode:

determine that a first reversing-valve fault is detected, wherein the first reversing-valve fault is associated with the reversing valve being in a heating configuration when the HVAC system is intended to operate in the cooling mode;

transmit a signal instructing the reversing valve to change to an alternate position;

following a predefined delay time after transmitting the signal, determine whether the heat-exchanger temperature is still less than the outdoor temperature;

in response to determining that the heat-exchanger temperature is no longer less than the outdoor temperature, determine that the reversing-valve fault is resolved; and in response to determining that the heat-exchanger temperature is still less than the outdoor temperature, determine that the reversing-valve fault is unresolved.

2. The system of claim 1, the controller further configured to determine that the heat-exchanger temperature is less than the outdoor temperature by:

determining a difference between the heat-exchanger temperature and the outdoor temperature; and determining that the difference is less than zero and less than a predefined threshold value.

3. The system of claim 1, further configured to:

in response to determining the heat-exchanger temperature is greater than the outdoor temperature and that the HVAC system is intended to operate in the heating mode, determine that a second reversing-valve fault is detected, wherein the second reversing-valve fault is associated with the reversing valve being in a cooling configuration when the HVAC system is intended to operate in the heating mode.

4. The system of claim 1, the controller further configured to determine that the heat-exchanger temperature is less than the outdoor temperature by:

comparing the outdoor and heat-exchanger temperatures for at least a minimum period of time; and determining the heat-exchanger temperature is less than the outdoor temperature for at least the period of time.

5. The system of claim 1, the controller further configured to, in response to determining that the first reversing-valve fault is detected, transmit an alert comprising an indication that the reversing valve is in the heating configuration when the HVAC system is intended to operate in the cooling mode.

6. The system of claim 1, the controller further configured to, in response to determining that the reversing-valve fault is detected, stop operation of a compressor of the HVAC system.

7. A method of operating a heating, ventilation and air conditioning (HVAC) system, the method comprising:

monitoring a first temperature corresponding to an outdoor temperature;

monitoring a second temperature associated with an outdoor heat exchanger of the HVAC system;

comparing the monitored first temperature to the monitored second temperature;

determining whether the HVAC system is intended to operate in a cooling mode or heating mode;

in response to determining that the second temperature is less than the first temperature and that the HVAC system is intended to operate in the cooling mode:

determining that a first reversing-valve fault is detected, wherein the first reversing-valve fault is associated with the reversing valve being in a heating configuration when the HVAC system is intended to operate in the cooling mode;

transmitting a signal instructing the reversing valve to change to an alternate position;

following a predefined delay time after transmitting the signal, determining whether the second temperature is still less than the first temperature;

in response to determining that the second temperature is no longer less than the first temperature, determining that the reversing-valve fault is resolved; and in response to determining that the second temperature is still less than the first temperature, determining that the reversing-valve fault is unresolved.

8. The method of claim 7, further comprising determining that the second temperature is less than the first temperature by:

determining a difference between the second temperature and the first temperature; and determining that the difference is less than zero and less than a predefined threshold value.

9. The method of claim 7, further comprising:

in response to determining the second temperature is greater than the first temperature and that the HVAC system is intended to operate in the heating mode, determining that a second reversing-valve fault is detected, wherein the second reversing-valve fault is associated with the reversing valve being in a cooling configuration when the HVAC system is intended to operate in the heating mode.

10. The method of claim 7, further comprising determining that the second temperature is less than the first temperature by:

comparing the first and second temperatures for at least a minimum period of time; and determining the second temperature is less than the first temperature for at least the period of time.

11. The method of claim 7, further comprising, in response to determining that the first reversing-valve fault is detected, transmitting an alert comprising an indication that the reversing valve is in the heating configuration when the HVAC system is intended to operate in the cooling mode.

12. The method of claim 7, further comprising, in response to determining that the reversing-valve fault is detected, stopping operation of a compressor of the HVAC system.

13. A controller of a heating, ventilation and air conditioning (HVAC) system, the controller comprising:

an input/output interface configured to communicatively couple the controller to:

a data source providing measurements of a first temperature corresponding to an outdoor temperature; and a sensor positioned and configured to measure a second temperature associated with an outdoor heat exchanger of the HVAC system; and a processor coupled to the input/output interface, the processor configured to:

monitor, based on measurements received from the data source, the first temperature;

monitor, based on measurements received from the sensor, the second temperature;

compare the monitored first temperature to the monitored second temperature;

determine whether the HVAC system is intended to operate in a cooling mode or heating mode;

in response to determining that the second temperature is less than the first temperature and that the HVAC system is intended to operate in the cooling mode:

determine that a first reversing-valve fault is detected, wherein the first reversing-valve fault is associated with the reversing valve being in a heating configuration when the HVAC system is intended to operate in the cooling mode;

cause the input/output interface to transmit a signal instructing the reversing valve to change to an alternate position;

following a predefined delay time after transmitting the signal, determine whether the second temperature is still less than the first temperature;

in response to determining that the second temperature is no longer less than the first temperature, determine that the reversing-valve fault is resolved; and in response to determining that the second temperature is still less than the first temperature, determine that the reversing-valve fault is unresolved.

14. The controller of claim 13, the processor further configured to determine that the second temperature is less than the first temperature by:

determining a difference between the second temperature and the first temperature; and determining that the difference is less than zero and less than a predefined threshold value.

15. The controller of claim 13, the processor further configured to:

in response to determining the second temperature is greater than the first temperature and that the HVAC system is intended to operate in the heating mode, determine that a second reversing-valve fault is detected, wherein the second reversing-valve fault is associated with the reversing valve being in a cooling configuration when the HVAC system is intended to operate in the heating mode.

16. The controller of claim 13, the processor further configured to determine that the second temperature is less than the first temperature by:

comparing the first and second temperatures for at least a minimum period of time; and determining the second temperature is less than the first temperature for at least the period of time.

17. The controller of claim 13, the processor further configured to, in response to determining that the reversing-valve fault is detected, stop operation of a compressor of the HVAC system.

* * * * *